United States Patent [19]

Hasegawa et al.

[11] 4,434,764

[45] Mar. 6, 1984

[54] AIR/FUEL RATIO FEEDBACK CONTROL SYSTEM FOR INTERNAL COMBUSTION ENGINES, HAVING ATMOSPHERIC PRESSURE-DEPENDENT FAIL SAFE FUNCTION FOR $O_2$ SENSOR

[75] Inventors: Shumpei Hasegawa, Niiza; Shin Narasaka, Yono; Kazuo Otsuka, Higashikurume, all of Japan

[73] Assignee: Honda Motor Co., Ltd., Tokyo, Japan

[21] Appl. No.: 407,658

[22] Filed: Aug. 12, 1982

[30] Foreign Application Priority Data

Aug. 13, 1981 [JP] Japan ..... 56-128313

[51] Int. Cl.[3] ..... F02M 7/18

[52] U.S. Cl. ..... 123/440; 123/489

[58] Field of Search ..... 123/440, 489

[56] References Cited

U.S. PATENT DOCUMENTS 3,948,228 4/1976 Luchaco ..... 123/489 X
4,121,548 10/1978 Hattori et al. ..... 123/489 X
4,214,308 7/1980 Carp ..... 123/489 X
4,376,431 3/1983 Yokooku et al. ..... 123/492 X
4,383,409 5/1983 Otsuka et al. ..... 123/440 X
4,393,842 7/1983 Otsuka et al. ..... 123/440

*Primary Examiner*—Tony M. Argenbright
*Attorney, Agent, or Firm*—Arthur L. Lessler

[57] ABSTRACT

An air/fuel ratio feedback control system for internal combustion engines, which includes: a fail safe device comprising at least one of a first failure detecting means for detecting whether no inversion occurs in the output level of the $O_2$ sensor over a predetermined period of time during air/fuel ratio feedback control dependent upon the $O_2$ sensor output when the $O_2$ sensor is activated, and a second failure detecting means for detecting whether no activation of the $O_2$ sensor occurs over a second predetermined period of time after the engine temperature has risen above a predetermined value during the above feedback control; and means for rendering the fail safe device inoperative when a detected value of ambient atmospheric pressure is lower than a predetermined value.

5 Claims, 9 Drawing Figures

WARNING DEVICE
77
76
A
75
75c
75b
OSCILLATOR
COUNTER
R
75a
S12
S13
S2
S11
S4
74
74a
C
R
S3
80
80b
80a
S14
OSCILLATOR
COUNTER
R
81
B
79
COMP
+V
R2
R1
R3
83
S4
S13
FF
82
S1
COMP 2
78
+V
R4
R5
R6
PA
S1
TW

AIR/FUEL RATIO FEEDBACK CONTROL SYSTEM FOR INTERNAL COMBUSTION ENGINES, HAVING ATMOSPHERIC PRESSURE-DEPENDENT FAIL SAFE FUNCTION FOR $O_2$ SENSOR

BACKGROUND OF THE INVENTION

This invention relates to air/fuel ratio control systems for internal combustion engines, and more particularly to a device provided in such a control system for interrupting, at low atmospheric pressure, operation of a fail safe device for an $O_2$ sensor for detecting the concentration of oxygen in the engine exhaust gases.

An air/fuel ratio feedback control system for internal combustion engines has already been proposed by the applicants of the present application e.g. in U.S. Ser. No. 281,118 filed July 7, 1981, now Pat. No. 4,380,985, which comprises an $O_2$ sensor for detecting the concentration of oxygen present in the exhaust gases emitted from an internal combustion engine, and air/fuel ratio control valve having a valve body disposed to determine the air/fuel ratio of an air/fuel mixture being supplied to the engine, and an actuator arranged to drive the air/fuel ratio valve in response to an output signal of the $O_2$ sensor, thus to carry out feedback conrol of the air/fuel ratio responsive to changes in the above oxygen concentration so as to keep the air/fuel ratio at a predetermined value.

The $O_2$ sensor used in the above air/fuel ratio feedback control system is comprised of a sensor element made of stabilized zirconium oxide or a like material. The $O_2$ sensor is adapted to detect the concentration of oxygen in the engine exhaust gases in such a manner that the output voltage of the $O_2$ sensor varies correspondingly to a change in the conduction rate of oxygen ions through the interior of the zirconium oxide or a like material, which corresponds to a change in the difference between the oxygen partial pressure of the air and the equalibrium partial pressure of the oxygen in the engine exhaust gases.

The internal resistance of the $O_2$ sensor which determines the output voltage of the $O_2$ sensor also varies with a change in the degree of activation of the sensor. Thus, the activation of the $O_2$ sensor can be determined by measuring the internal resistance of the sensor. When inactive, the $O_2$ sensor has its output voltage variable within a small range and unable to vary in quick response to changes in the concentration of oxygen in the engine exhaust gases. Therefore, the air/fuel ratio feedback control operation is not initiated until after the $O_2$ sensor has become fully activated. During the feedback control operation which is thus initiated after full activation of the $O_2$ sensor, the air/fuel ratio of the mixture is controlled to values appropriate for the operating condition of the engine (which is a function of engine rpm, engine load, etc.) by means of the aforementioned air/fuel ratio control valve which is driven by an actuator such as a pulse motor in response to changes in the output voltage of the $O_2$ sensor.

Therefore, it goes without saying that a failure in the $O_2$ sensor would make it impossible to properly carry out the air/fuel ratio control operation. If in the event of $O_2$ sensor failure the air/fuel ratio feedback control operation is continued without taking any emergency measures, the air/fuel ratio might be controlled to abnormal values, adversely affecting the driveability and exhaust emission characteristics of the engine. Thus, in order to always ensure proper air/fuel ratio feedback control, measures are indispensable for immediately detecting a failure in the $O_2$ sensor and its related parts and taking appropriate actions upon detection of such failure.

Means for detecting a failure in the $O_2$ sensor have also been proposed by the present applicants, which include a type adapted to detect whether no inversion occures in the output level of the $O_2$ sensor over a predetermined period of time during the air/fuel feedback control when the $O_2$ sensor is activated, as proposed in U.S. Ser. No. 299,382 filed Sept. 4, 1981, and a type adapted to detect whether the $O_2$ sensor becomes activated within a predetermined period of time after the engine cooling water temperature has risen above a predetermined value during the air/fuel feedback control, as proposed in U.S. Ser. No. 299,675 filed Sept. 8, 1981. These proposed failure detecting means are both adapted to control a fuel metering device so as to achieve a predetermined air/fuel ratio compensated for atmospheric pressure, upon detection of a failure in the $O_2$ sensor.

On the other hand, in controlling the air/fuel ratio by the use of an ordinary fuel supply system, the mixture being supplied to the engine becomes excessively rich during engine operation at a high altitude where low atmospheric pressure prevails. To avoid this, according to the aforementioned air/fuel ratio feedback control system proposed by the applicants, the feedback control is effected such that the actuator is moved in response to the output signal of the $O_2$ signal in the direction of leaning the mixture so as to keep the air/fuel ratio at a theoretical value. However, even with this feedback air/fuel ratio correction, the ambient atmospheric pressure drops so largely that the mixture remains too rich in the event that the excessively rich mixture has an air/fuel ratio falling outside a limit value within which the feedback air/fuel ratio correction is possible. If the engine operation is continued in such condition, the output level of the $O_2$ sensor remains high above a predetermined reference level, that is, no inversion occurs in the output level of the $O_2$ sensor over a predetermined period of time. Also, when the engine is started under low atmospheric pressure at a high altitude, sometimes the output voltage of the $O_2$ sensor does not drop below a predetermined reference voltage provided as a criterion for activation of the $O_2$ sensor, even after a predetermined period of time has passed from the start of the engine. In these events, the $O_2$ sensor—fail safe device undesirably operates to carry out fail safe functions such as warning and diagnosis, though the $O_2$ sensor and its related parts are then not out of order.

OBJECT AND SUMMARY OF THE INVENTION

It is the object of the invention to provide an air/fuel ratio feedback control system for internal combustion engines, which is adapted to render the $O_2$ sensor—fail safe device inoperative at low atmospheric pressure for prevention of execution of fail safe functions, and to return the same device into operation for proper fail safe functions when the atmospheric pressure recovers its normal value.

An air/fuel ratio feedback control system according to the invention includes electronic control means for controlling the air/fuel ratio of an air/fuel mixture being supplied to the engine to a predetermined value in a feedback manner responsive to an output signal of the $O_2$ sensor, means adapted to generate a first signal as long as a predetermined condition for effecting the above feedback control is fulfilled, means adapted to generate a second signal as long as the $O_2$ sensor is activated, means operable to determine an actual air/fuel ratio of the mixture from the value of the output signal of the $O_2$ sensor and to generate a third signal having a binary value invertible depending upon whether the air/fuel ratio thus determined is larger or smaller than the above predetermined value, safety means arranged to be supplied with the first, second and third signals for performing a predetermined safety action when no inversion occurs in the third signal inputted thereto for a predetermined period of time while simultaneously the first and second signals are both inputter thereto, sensor means for detecting ambient atmospheric pressure, and means adapted to render the above safety means inoperative when a value of atmospheric pressure detected by the atmospheric pressure sensor means is lower than a predetermined value.

The air/fuel ratio feedback control system may further include second sensor means for detecting the temperature of the engine, means adapted to generate a fourth signal when a value of engine temperature detected by the second sensor is higher than a predetermined value, and second safety means arranged to be supplied with the first, second and fourth signals for performing a predetermined safety action when the second signal is not inputted thereto within a second predetermined period of time after the second and fourth signals have both been inputted thereto. In this embodiment, the means for rendering the first—mentioned safety means inoperative is now adapted to render both of the first—mentioned safety means and the second safety means when a value of atmospheric pressure detected by the second sensor means is lower than the aforementioned predetermined value.

The above and other objects, features and advantages of the invention will be more apparent from the ensuing detaild description taken in connection with the accompanying drawings in which:

DETAILED DESCRIPTION

Details of the present invention will now be described with reference to the drawings which illustrate an embodiment of the invention.

Figure 1:
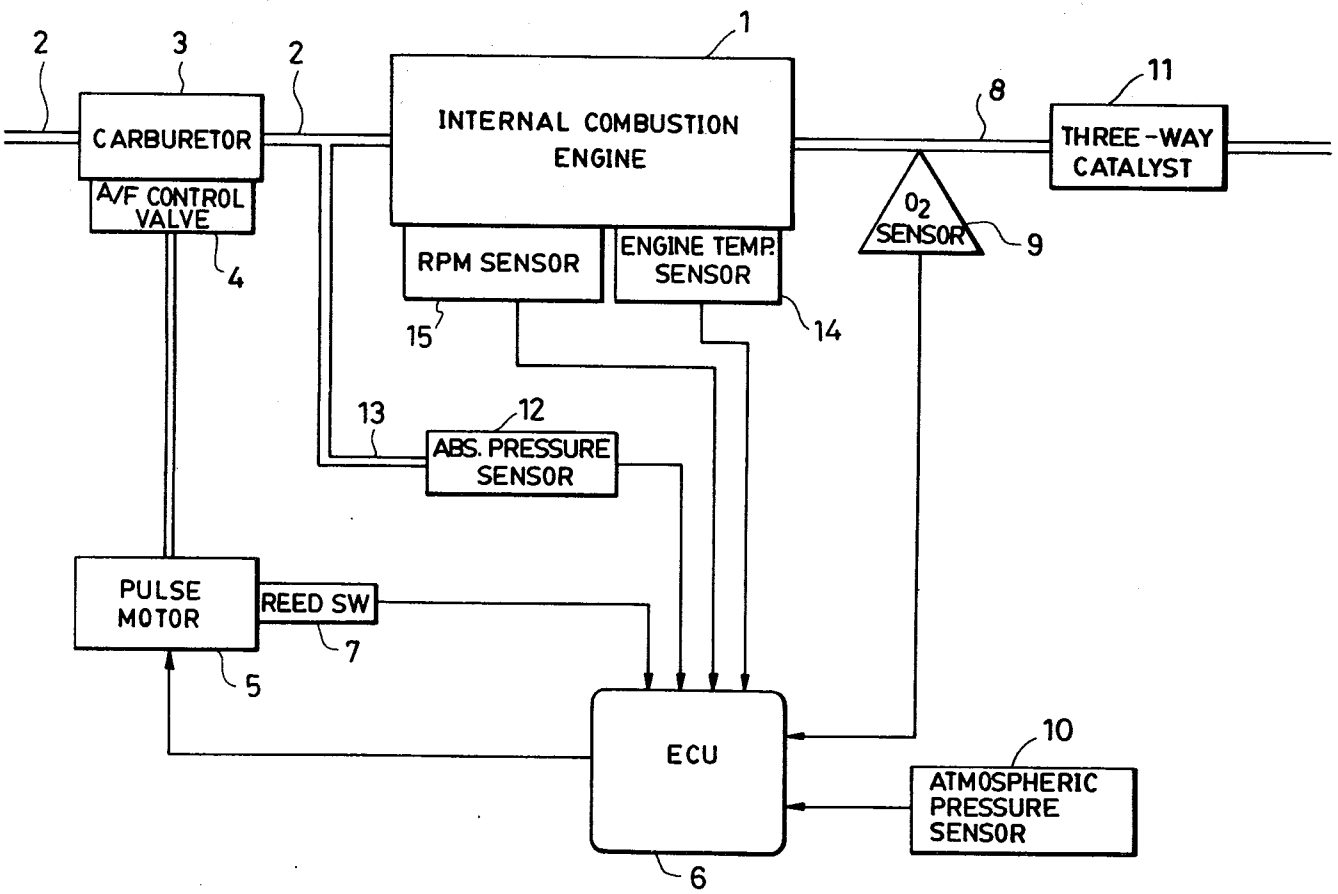
FIG. 1 is a block diagram illustrating the whole arrangement of an air/fuel ratio feedback control system for internal combustion engines according to an embodiment of the present invention.

Referring first to FIG. 1, there is shown a block diagram illustrating the whole arrangement of an air/fuel ratio feedback control system according to one embodiment of the invention.

Reference numeral 1 designates an internal combustion engine. Connected to the engine 1 is an intake manifold 2 which is provided with a carburetor generally designated by the numeral 3. The carburetor 3 has main and slow speed fuel passages, not shown, which communicate the float chamber, not shown, of the carburetor 3 with primary and secondary bores, not shown. These fuel passages communicate with the atmosphere by means of air bleed passages, not shown. The air bleed passages introduce atmospheric air into the fuel passages for mixing with fuel in the carburetor 3. The quantity of fuel being supplied to the engine 1 varies substantially in inverse proportion to the quantity of bleed air introduced into the fuel passages.

At least one of these air bleed passages is connected to an air/fuel ratio control valve 4. The air/fuel ratio control valve 4 is comprised of a required number of flow rate control valves, not shown, each of which is driven by a pulse motor 5 so as to vary the opening of the at least one of the above passages. The pulse motor 5 is electrically connected to an electronic control unit (hereinafter called "ECU") 6 to have its rotor rotated by driving pulses supplied therefrom so that the flow rate control valves are displaced to vary the flow rate of bleed air to control the fuel quantity being supplied to the engine 1 through the at least one passage. Although the fuel quantity or air/fuel ratio can be controlled by thus varying the flow rate of bleed air being supplied to the engine 1, the air/fuel ratio control valve 4 may be arranged to vary the opening of at least one of the aforementioned fuel passages to control the flow rate of fuel being supplied to the engine 1 in a direct manner, instead of varying the opening of at least one of the bleed air passages for control of the flow rate of bleed air.

The pulse motor 5 is provided with a reed switch 7 which is arranged to turn on or off depending upon the moving direction of the valve body of the air/fuel ratio control valve 4 each time the same valve body passes a reference position, to supply a corresponding binary signal to ECU 6.

On the other hand, an $O_2$ sensor 9, which is formed of stabilized zirconium oxide or the like, is mounted in the peripheral wall of an exhaust manifold 8 leading from the engine 1 in a manner projected into the manifold 8. The sensor 9 is electrically connected to ECU 6 to supply its output signal thereto. An atmospheric pressure sensor 10 is arranged to detect ambient atmospheric pressure surrounding the vehicle, not shown, in which the engine 1 is installed, the sensor 10 being electrically connected to ECU 6 to supply its output signal thereto, too.

Incidentally, in FIG. 1, reference numeral 11 designates a three-way catalyst, 12 a pressure sensor arranged to detect absolute pressure in the intake manifold 2 through a conduit 13 and electrically connected to ECU 6 to supply its output signal thereto, and 14 a thermistor arranged to detect the temperature of engine cooling water and also electrically connected to ECU 6 to supply its output signal thereto. Reference numeral 15 generally designates an engine rpm sensor which is comprised of a distributor and an ignition coil and arranged to supply pulses generated in the ignition coil to ECU 6.

Details of the air/fuel ratio control which can be performed by the air/fuel ratio control system according to the invention outlined above will now be described by further reference to FIG. 1 which has been referred to hereinabove.

INITIALIZATION

When the ignition switch in FIG. 1 is set on, ECU 6 is initialized to detect the reference position of the actuator or pulse motor 5 by means of the reed switch 7 and hence drive the pulse motor 5 to set its rotor to its best position (a preset rotor position) for starting the engine, that is, set the initial air/fuel ratio to a predetermined proper value. The rotor and a rotor position will be hereinafter referred to merely as the pulse motor and a pulse motor position, respectively. The above preset position of the pulse motor 5 is hereinafter called "PSCR." The above setting of the initial air/fuel ratio is made on condition that the engine rpm Ne is lower than a predetermined value NCR (e.g., 400 rpm) and the engine is in a condition before firing. The predetermined value NCR is set at a value higher than the cranking rpm and lower than the idle rpm.

The above reference position of the pulse motor 5 is detected as the position at which the reed switch 7 turns on or off, as previously mentioned with reference to FIG. 1.

Then, ECU 6 monitors the condition of activation of the $O_2$ sensor 9 and the coolant temperature Tw detected by the thermistor 14 to determine whether or not the engine is in a condition for initiation of the air/fuel ratio control. For accurate air/fuel ratio feedback control, it is a requisite that the $O_2$ sensor 9 is fully activated and the engine is in a warmed-up condition. The $O_2$ sensor, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 6, the electrical terminal potential or output voltage of the sensor initially shows a value close to the power supply voltage (e.g., 5 volts) when the sensor is not activated, and then, its electrical terminal potential lowers with the increase of its temperature. Therefore, according to the invention, the air/fuel ratio feedback control is not initiated until after the conditions have been fulfilled that the sensor produces an activation-indicative signal when its output voltage lowers down to a predetermined voltage Vx (e.g., 0.5 volt), an associated timer finishes counting for a predetermined period of time tx (e.g., 1 minute) starting from the occurrence of the above activation-indicative signal, and the coolant temperature Tw increases up to a predetermined value Twx (e.g., 35° C.) at which an automatic choke, not shown, provided in the intake pipe of the engine is opened to an opening for enabling the air/fuel ratio feedback control.

During the above stage of the detection of activation of the $O_2$ sensor and the coolant temperature Tw, the pulse motor 5 is held at its predetermined position PSCR. The pulse motor 5 is driven to appropriate positions in response to the operating condition of the engine after initiation of the air/fuel ratio control, as hereinlater described.

BASIC AIR/FUEL RATIO CONTROL

Following the initialization, the program in ECU 6 proceeds to the basic air/fuel ratio control.

ECU 6 is responsive to various detected value signals representing the output voltage V or the $O_2$ sensor 9, the absolute pressure PB in the intake manifold 2 detected by the pressure sensor 12, the engine rpm Ne detected by the rpm sensor 15, and the atmospheric pressure PA detected by the atmospheric pressure sensor 10, to drive the pulse motor 5 as a function of the values of these signals to control the air/fuel ratio. More specifically, the basic air/fuel ratio control comprises open loop control which is carried out at wide-open-throttle, at engine idle, at engine deceleration, and at engine acceleration at the standing start of the engine, and closed loop control which is carried out at engine partial load. All the control is initiated after completion of the warming-up of the engine.

First, the condition of open loop control at wide-open-throttle is met when the differential pressure PA -PB (gauge pressure) between the absolute pressure PB detected by the pressure sensor 12 and the atmospheric pressure PA (absolute pressure) detected by the atmospheric pressure sensor 10 is lower than a predetermined value ΔPWOT. ECU 6 compares the diference in value between the output signals of the sensors 10, 12 with the predetermined value ΔPWOT stored therein, and when the relationship of $P_A - P_B < \Delta P_{WOT}$ stands, drives the pulse motor 5 to a predetermined position (preset position) PSWOT and holds it there.

The condition of open loop control at engine idle is met when the engine rpm Ne is lower than a predetermined idle rpm NIDL )e.g., 1,000 rpm). ECU 6 compares the output signal value Ne of the rpm sensor 15 with the predetermined rpm NIDL stored therein, and when the relationship of $Ne < N_{IDL}$ stands, drives the pulse motor 5 to a predetermined idle position (preset position) PSIDL and holds it there.

The above predetermined idle rpm NIDL is set at a value slightly higher than the actual idle rpm to which the engine concerned is adjusted.

The condition of open loop control at engine deceleration is fulfilled when the absolute pressure PB in the intake manifold 2 is lower than a predetermined value PBDEC. ECU 6 compares the output signal value PB of the pressure sensor 12 with the predetermined value PBDEC stored therein, and when the relationship of $P_B < P_{BDEC}$ stands, drives the pulse motor 5 to a predetermined deceleration position (preset position) PSDEC and holds it there.

The air/fuel ratio control at engine acceleration (i.e., standing start or off—idle acceleration) is carried out when the engine rpm Ne exceeds the aforementioned predetermined idle rpm NIDL (e.g., 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 6 rapidly moves the pulse motor 5 to a predetermined acceleration position (present position) PSACC, which is immediately followed by initiation of the air/fuel ratio feedback control, described hereinlater.

During operations of the above-mentioned open loop control at wide-open-throttle, at engine idle, at engine deceleration, and at engine off-idle acceleration, the respective predetermined positions PSWOT, PSIDL, PSDEC and PSACC for the pulse motor 5 are compensated for atmospheric pressure PA, as hereinlater described.

On the other hand, the condition of closed loop control at engine partial load is met when the engine is in an operating condition other than the above-mentioned open loop control conditions. During the closed loop control, ECU 6 performs selectively feedback control based upon proportional term correction (hereinafter called "P term control") and feedback control based upon integral term correction (hereinafter called "I term control"), in response to the engine rpm Ne detected by the engine rpm sensor 15 and the output signal V of the $O_2$ sensor 9. To be concrete, when the output voltage V of the $O_2$ sensor 9 varies only at the higher level side or only at the lower level side with respect to a reference voltage Vref, the position of the pulse motor 5 is corrected by an integral value obtained by integrating the value of a binary signal which changes in dependence on whether the output voltage of the $O_2$ sensor is at the higher level or at the lower level with respect to the predetermined reference voltage Vref (I term control). On the other hand, when the output signal V of the $O_2$ sensor changes from the higher level to the lower level or vice versa, the position of the pulse motor 5 is corrected by a value directly proportional to a change in the output voltage V of the $O_2$ sensor (P term control).

According to the above I term control, the number of steps by which the pulse motor is to be displaced per second is increased with an increase in the engine rpm so that it is larger in a higher engine rpm range.

Whilst, according to the P term control, the number of steps by which the pulse motor is to be displaced per second is set at a single predetermined value (e.g., 6 steps), irrespective of the engine rpm.

In transition from the above-mentioned various open loop control to the closed loop control at engine partial load or vice versa, changeover between open loop mode and closed loop mode is effected in the following manner: First, in changing from closed loop mode to open loop mode, ECU 6 moves the pulse motor 5 to a predetermined position PSCR, PSWOT, PSIDL, PSDEC or PSACC and holds it there, irrespective of the position at which the pulse motor was located immediately before entering each open loop control. This predetermined position is corrected in response to actual atmospheric pressure as hereinlater referred to.

On the other hand, in changing from open loop mode to closed loop mode, ECU 6 commands the pulse motor 5 to initiate an air/fuel ratio feedback control motion with I term correction.

To obtain optimum exhaust emission characteristics irrespective of changes in the actual atmospheric pressure during open loop air/fuel ratio control or at the time of shifting from open loop mode to closed loop mode, the position of the pulse motor 5 needs to be compensated for atmospheric pressure. According to the invention, the above-mentioned predetermined or preset positions PSCR, PSWOT, PSIDL, PSDEC and PSACC at which the pulse motor 5 is to be held during the respective open loop control operations are corrected in a linear manner as a function of changes in the atmospheric pressur PA, using the following equation:

$$PSi(P_A) = PSi + (760 - P_A) \times Ci$$

where i represents any one of CR, WOT, IDL, DEC and ACC, accordingly PSi represents any one of PSCR, PSWOT, PSIDL, PSDEC and PSACC at 1 atmospheric pressure (=760 mmHg), and Ci a correction coefficient, representing any one of CCR, CWOT, CIDL, CDEC and CACC. The values of PSi and Ci are previously stored in ECU 6.

ECU 6 applies to the above equation the coefficients PSi, Ci which are determined at proper different values according to the kinds of open loop control to be carried out, to calculate by the above equation the position PSi (PA) for the pulse motor 5 to be set at a required kind of open loop control and moves the pulse motor 5 to the calculated position PSi (PA).

Figures 2, 2A, 2B:
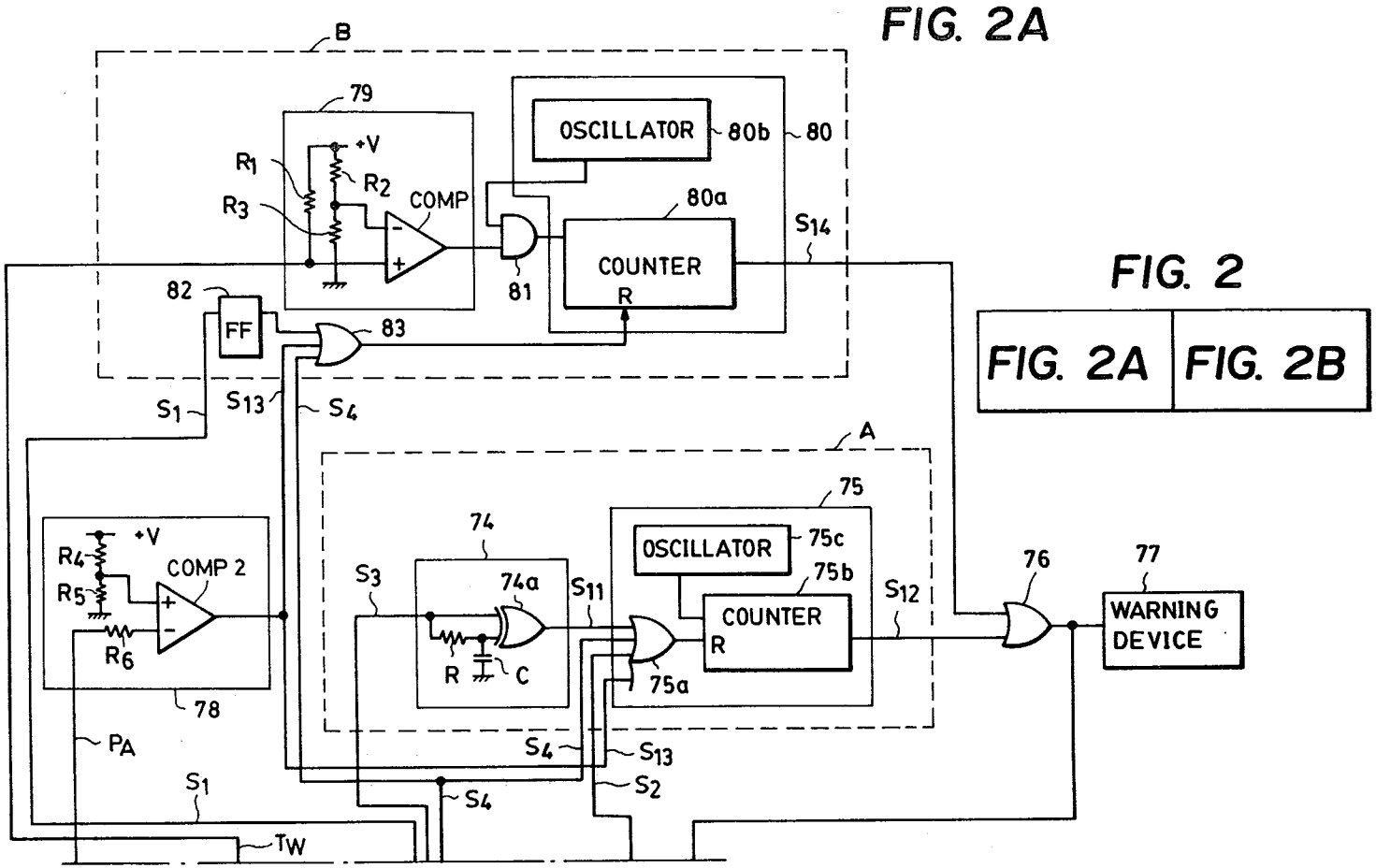
FIGS. 2, 2A and 2B are circuit diagrams illustrating an electrical circuit provided in the electronic control unit in FIG. 1, with an $O_2$ sensor—fail safe device and means for rendering same inoperative shown in particular detail.
Figure 2B:
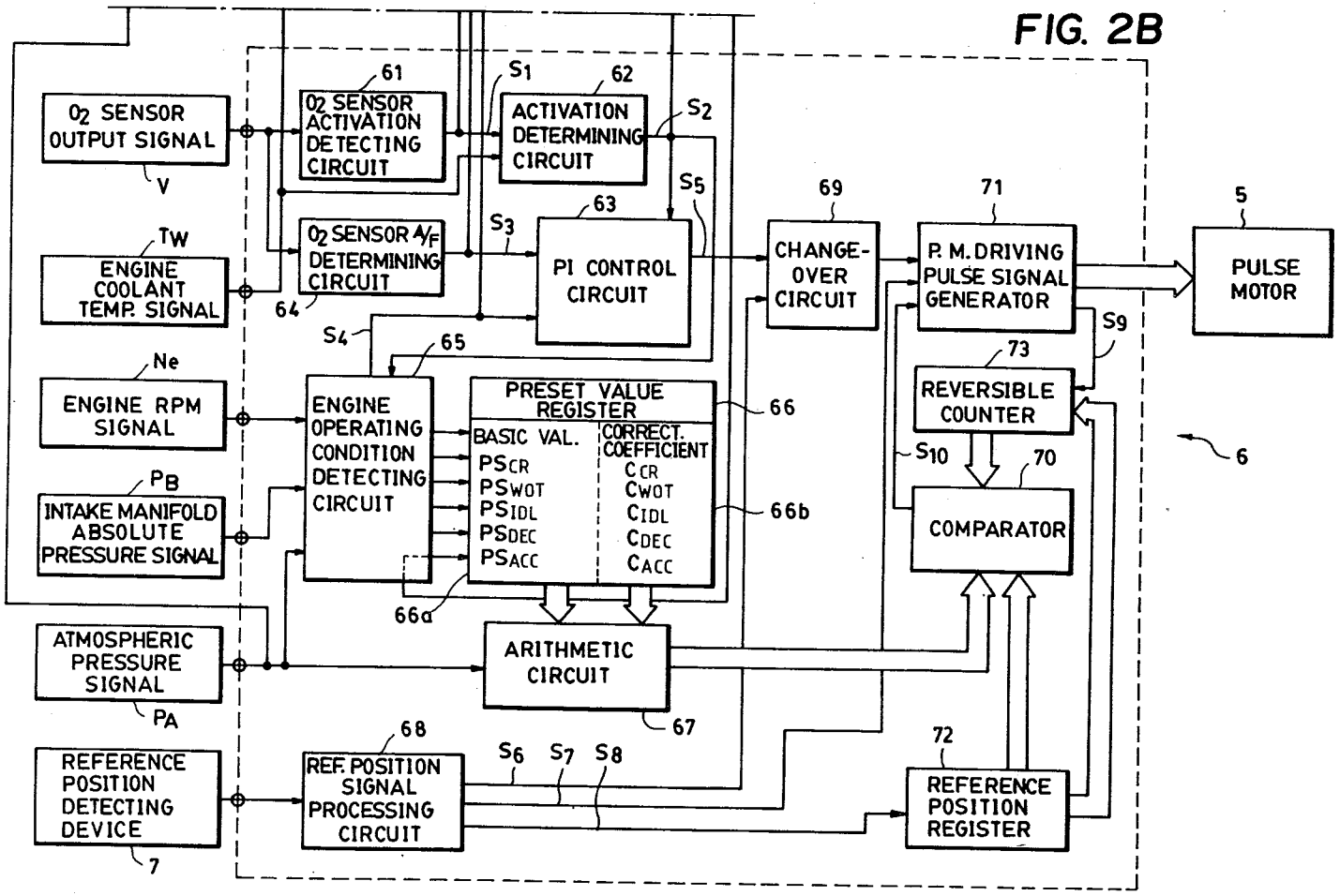

FIG. 2 is a block diagram illustrating the interior construction of ECU 6 used in the air/fuel ratio control system having the above-mentioned functions according to the invention. In ECU 6, reference numeral 61 designates a circuit for detecting the activation of the $O_2$ sensor 9 in FIG. 1, which is supplied at its input with an output signal V from the $O_2$ sensor. Upon passage of the predetermind period of time tx after the voltage of the above output signal V has dropped below the predetermined value Vx, the above circuit 61 supplies an activation-indicative signal $S_1$ to an activation determining circuit 62. This activation determining circuit 62 is also supplied at its input with an engine coolant temperature signal tw from the thermistor 14 in FIG. 1. When supplied with both the above activation-indicative signal $S_1$ and the coolant temperature signal Tw indicative of a value exceeding the predetermined value Twx, the activation determining circuit 62 supplies an air/fuel ratio control initiation command signal $S_2$ to a PI control circuit 63 to render same ready to operate. Reference numeral 64 represents an air/fuel ratio determining circuit which determines the actual value of air/fuel ratio of the mixture, depending upon whether or not the output voltage of the $O_2$ sensor 9 is larger than the predetermined value Vref, that is, whether or not the oxygen concentration in the engine exhaust gases has a value larger than a value corresponding to the theoretical air/fuel ratio, to supply a binary signal $S_3$ indicative of the value of air/fuel ratio thus obtained, to the PI control circuit 63. On the other hand, an engine operating condition detecting circuit 65 is provided in ECU 6, which is supplied with an engine rpm signal Ne from the engine rpm sensor 15, an absolute pressure signal PB from the pressure sensor 12, an atmospheric pressure signal PA from the atmospheric pressure sensor 10, all the sensors being shown in FIG. 1, and the above control initiation command signal $S_2$ from the activation determining circuit 62 in FIG. 2, respectively. The circuit 65 supplies a control signal $S_4$ indicative of a value corresponding to the values of the above input signals to the PI conrol circuit 63. The PI control circuit 63 accodingly supplies a change-over circuit 69 to be referred to later with a pulse motor control pulse signal $S_5$ having a value corresponding to the value of the air/fuel ratio signal $S_3$ outputted from the air/fuel ratio determining circuit 64 and a signal component corresponding to the engine rpm Ne in the control signal $S_4$ supplied from the engine operating condition detecting circuit 65. The engine operating condition detecting circuit 65 also supplies the PI control circuit 63 with the above control signal $S_4$ containing a signal component corresponding to the engine rpm Ne, the absolute pressure PB in the intake manifold, atmospheric pressure PA and the value of air/fuel ratio control initiation command signal $S_2$. When supplied with the above signal component from the engine operating condition detecting circuit 65, the PI control circuit 63 interrupts its own operation. Upon interruption of the supply of the above signal component to the control circuit 63, a control pulse signal $S_5$ is outputted from the circuit 63 to the change-over circuit 69, which signal starts air/fuel ratio control with integral term correction.

A preset value register 66 is provided in ECU 6, which is formed of a basic value register section 66*a* in which are stored the basic values of preset values PSCR, PSWOT, PSIDL, PSDEC and PSACC for the pulse motor position, applicable to various engine conditions, and a correcting coefficient register section 66*b* in which are stored atmospheric pressure correcting coefficients CCR, CWOT, CIDL, CDEC and CACC for these basic values. The engine operating condition detecting circuit 65 detects the operating condition of the engine based upon the activation of the $O_2$ sensor and the values of engine rpm Ne, intake manifold absolute pressure PB and atmospheric pressure PA to read from the register 66 the basic value of a preset value corresponding to the detected operating condition of the engine and its corresponding correcting coefficient and apply same to an arithmetic circuit 67. The arithmetic circuit 67 performs arithmetic operation responsive to the value of the atmospheric pressure signal PA, using the equation $PSi(PA)=PSi+(760-PA)\times Ci$. The resulting preset value is applied to a comparator 70.

On the other hand, a reference position signal processing circuit 68 is provided in ECU 6, which is responsive to the output signal of the reference position detecting device (reed switch) 7, indicative of the switching of same, to generate a binary signal $S_6$ having a certain level from the start of the engine until it is detected that the pulse motor reaches the reference position. This binary signaL $S_6$ is supplied to the change-over circuit 69 which in turn keeps the control pulse signal $S_5$ from being transmitted from the PI control circuit 63 to a pulse motor driving signal generator 71 as long as it is supplied with this binary signal $S_6$, thus avoiding the interference of the operation of setting the pulse motor to the initial position with the operation of P-term/I-term control. The reference position signal processing circuit 68 also generates a pulse signal $S_7$ in response to the output signal of the reference position detecting device 7, which signal causes the pulse motor 5 to be driven in the step-increasing direction or in the step-decreasing direction so as to detect the reference position of the pulse motor 5. This signal $S_7$ is supplied directly to the pulse motor driving signal generator 71 to cause same to drive the pulse motor 5 until the reference position is detected. The reference position signal processing circuit 68 generates another pulse signal $S_8$ each time the reference position is detected. This pulse signal $S_8$ is supplied to a reference position register 72 in which the value of the reference position (e.g., 50 steps) is stored. This register 72 is responsive to the above signal $S_8$ to apply its stored value to one input terminal of the comparator 70 and to the input of a reversible counter 73. The reversible counter 73 is also supplied with an output pulse signal $S_9$ generated by the pulse motor driving signal generator 71 to count pulses of the signal $S_9$ corresponding to the actual position of the pulse motor 5. When supplied with the stored value from the reference position register 72, the counter 79 has its counted value replaced by the value of the reference position of the pulse motor.

The counted value thus renewed is applied to the other input terminal of the comparator 70. Since the comparator 70 has its other input terminal supplied with the same pulse motor reference position value, as noted above, no output signal is supplied from the comparator 70 to the pulse motor driving signal generator 71 to thereby hold the pulse motor at the reference position with certainty. Subsequently, when the $O_2$ sensor 9 remains deactivated, an atmospheric pressure-compensated preset value PSCR (PA) is outputted from the arithmetic circuit 67 to the one input terminal of the comparator 70 which in turn supplies an output signal $S_{10}$ corresponding to the difference between the preset value PSCR (PA) and a counted value supplied from the reversible counter 79, to the pulse motor driving signal generator 71, to thereby achieve accurate control of the position of the pulse motor 5. Also, when the other open loop control conditions are detected by the engine operating condition detecting circuit 65, similar operations to that just described above are carried out.

In FIG. 2, symbol A generally designates a first failure detecting arrangement for the $O_2$ sensor 9, which comprises an $O_2$ sensor outout change detecting circuit 74, and a timer circuit 75. The $O_2$ sensor output change detecting circuit 74 is comprised of an exclusive OR circuit 74*a* which has its one input terminal connected directly to the output of the air/fuel ratio determining circuit 64 and its other input terminal connected to the output of the same circuit 64 by way of a delay circuit formed of a resistance R and a capacitor C. The exclusive OR circuit 74*a* has its output terminal connected to one input terminal of an OR circuit 75*a* forming part of the time circuit 75. The OR circuit 75*a* has another input terminal connected to the output of the $O_2$ sensor activation determining circuit 62 to be supplied with the activation signal $S_2$ indicative of the activation of the $O_2$ sensor 9. The OR circuit 75*a* has a further input terminal connected to the output of the engine operating condition detecting circuit 65 to be supplied with the control signal $S_4$ which commands selectively open loop control and closed loop control, depending upon the operating condition of the engine.

The OR circuit 75*a* has a still further input terminal connected to the output of an atmospheric pressure comparator 78 which is adapted to supply the OR circuit 75*a* with a binary signal $S_{13}$ having a level invertible depending upon whether ambient atmospheric pressure detected by the atmospheric pressure sensor 10 has a value loer than a predetermined value PAMIN. This predetermined value PAMIN is a value below which the air/fuel ratio of the mixture can assume a value too small for the engine to properly operate, even when the feedback control is carried out by the above stated feedback control circuit. The OR circuit 75*a* has its output connected to the reset pulse input terminal R of a counter 75*b* which in turn has its counting pulse input terminal connected to the output of an oscillator 75*c* which is adapted to generate pules with a constant period. The counter 75*b* has its output connected, by way of a OR circuit 76, to the input of a warning device 77 which is also connected to the operating condition detecting circuit 65.

The operation of the first failure detecting arrangement A will now be described by reference to FIGS. 2 and 3. The engine operating condition detecting circuit 65 supplies the OR circuit 75*a* of the abnormality detecting circuit 75 with the binary signal $S_4$ which has a high level of 1 during open loop control and a low level of 0 during closed loop control, respectively (FIG. 3 (*a*)). The $O_2$ sensor activation determining circuit 62 supplies the OR circuit 75*a* with the binary signal $S_2$ which has a high level of 1 indicative of deactivation of the $O_2$ sensor 9 when not supplied at one time with both of the $O_2$ sensor activation-indicative signal $S_1$ and the engine coolant temperature signal Tw indicative of the engine coolant temperature having a value exceeding the predetermined value Twx, and has a low level of 0 indicative of activation of the $O_2$ sensor 9 when supplied at one time with both of the above signals $S_1$ and Tw (FIG. 3 (*b*), (*c*)). On the other hand, the air/fuel ratio determining circuit 64 applies the binary signal $S_3$ corresponding in value to the output voltage of the $O_2$ sensor 9 to the above one input terminal of the exclusive OR circuit 74*a* of the $O_2$ sensor output change detecting circuit 74 (FIG. 3(*b*), (*d*)). The same binary signal $S_3$ is also applied to the above other input terminal of the same circuit 74*a* by way of the delay circuit RC, with a delay corresponding to the time constant of the same circuit RC. Therefore, at the instant of inversion of the binary signal $S_3$, the binary signal $S_3$ of 1 is applied to only either one of the input terminals of the circuit 74*a*, the cicuit 74*a* generates an output signal $S_{11}$ having a high level of 1 (FIG. 3 (*e*)).

Figure 3:
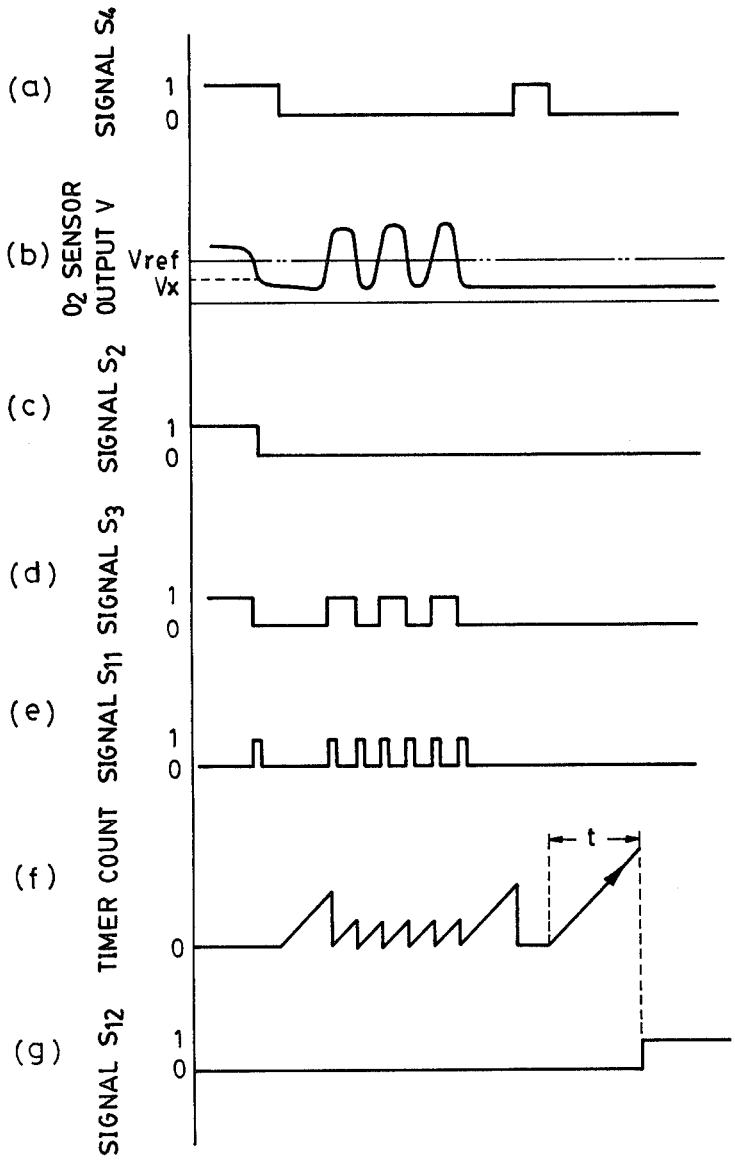
FIG. 3 is a timing chart showing the operation of first failure detecting means forming part of the $O_2$ sensor—fail safe device in FIG. 2.

The counter 75*b* of the timer circuit 75 is adapted to be resetted to zero by the output signal of 1 of the OR circuit 75*a*, to generate a binary signal $S_{12}$ having a high level of 1 as an abnormality-indicative signal when it counts up a predetermined number of pulses supplied from the oscillator 75*c*, which corresponds to a predetermind period of time t (e.g., one minute) (FIG. 3 (*g*)).

During open loop control or when the $O_2$ sensor 9 is not yet activated and simultaneously the engine coolant temperature Tw does not yet exceed the predetermined value Twx, the OR circuit 75*a* is supplied with the binary signal $S_4$ or the binary signal $S_2$, both having a high level of 1 (FIG. 3 (*a*), (*c*)). Accordingly, on this occasion the counter 75*b* is always kept in a resetted state by the output signal of 1 of the OR circuit 75*a* to have its count held at zero, even if the signal $S_{11}$ is applied to the circuit 75*a* by the $O_2$ sensor output change detecting ciruit 74 (FIG. 3 (*f*)).

During closed loop control and when the $O_2$ sensor 9 becomes activated and simultaneously the engine coolant temperature Tw exceeds the predetermined value Twx, the signals $S_4$ and $S_2$ applied to the OR circuit 75*a* are both low in level (FIG. 3 (*a*), (*c*)). On the other hand, the $O_2$ sensor output change detecting circuit 74 applies the inversion-indicative signal $S_{11}$ to the OR circuit 75*a* each time of inversion of the signal $S_3$ corresponding to the change of the output voltage of the $O_2$ sensor 9 (FIG. 3 (*d*), (*e*)). The counter 75*b* is resetted each time it is supplied with a pulse of the signal $S_{11}$ through the OR circuit 75*a*. However, when the $O_2$ sensor 9 normally operates in a manner that its output voltage incessantly changes from its higher level to its lower level or vice versa with respect to the reference volage Vref, the counter 75*b*, after resetted by a pulse of the signal $S_{11}$, is again resetted by the next pulse of the same signal $S_{11}$ before counting up the predetermined number of pulses corresponding to the predetermined period of time t outputted from the oscillator 75*c*. Thus, the counter 75*b* does not generate the abnormality-indicative signal $S_{12}$ of 1 (FIG. 3 (*e*), (*f*)).

When there occurs a failure in one of the $O_2$ sensor 9, ECU 6, the carburetor 3, the pulse motor 5, and the wiring related to these devices, the output voltage of the $O_2$ sensor 9 does not change, that is, stays at either one of the higher level and the lower level with respect to the reference voltage Vref even during closed loop control (FIG, 3 (*b*)). As a consequence, no pulse of the signal $S_{11}$ indicative of inversion of the signal $S_3$ is applied to the reset pule input terminal R of the counter 75*b* so that the counter 75*b* counts up the predetermined number of pulses corresponding to the predetermined period of time t supplied from the oscillator 75*c* to generate the abnormality-indicative signal $S_{12}$ having a high level of 1 (FIG. 3 (*f*), (*g*)). This high level signal $S_{12}$ is applied to the warning device 77 through the OR circuit 76 to actuate the same device. Further, the high level signal $S_{12}$ is also supplied to the engine operating condition detecting circuit 65 which in turn operates on the input signal $S_{12}$ to apply the control signal $S_4$ having a high level of 1 to the PI control circuit 63 to interrupt the operation of same and read the preset value PSIDL from the basic value register section 66*b* of the preset value register 66 and the corresponding correcting coefficient CIDL from the correcting coefficient register section 66*b*, respectively, into the arithmetic circuit 67. Thus, the pulse motor 5 is driven to the atmospheric pressure-compensated predetermined position PSIDL (PA) and held there in the aforedescribed manner.

Referring next to FIG. 2, symbol B generally designates a second failure detecting arrangement for the $O_2$ sensor, which comprises a temperature determining circuit 79 for determining whether or not the engine coolant temperaure Tw has reached the predetemined value Twx, and an abnormally determining circuit 80 for determining the occurrence of a failure in the $O_2$ sensor and its related parts. The temperature determining circuit 79 is comprised of a comparator COMP which has its non-inverting input terminal connected to the junction of one end of the engine coolant temperature sensor (thermistor) 14 in FIG. 1 which has its other end grounded, with one end of a resistance $R_1$ which has its other end connected to a suitable positive voltage power source, not shown. Connected to the inverting input terminal of the comparator COMP is the junction of a resistance $R_2$ with a resistance $R_3$, the resistances $R_2$ and $R_3$ being serially connected between the above positive voltage power source and the ground to provide at their junction a reference voltage which corresponds to the aforementioned predetermined value Twx of the engine coolant temperature. The comparator COMP of the temperature determining circuit 79 has its output terminal connected to one input terminal of an AND circuit 81. The AND circuit 81 has its output terminal connected to the counting pulse input terminal of a counter 80*a* forming part of the abnormality determining circuit 80. The abnormality determining circuit 80 has an oscillator 80*b* which is connected at its output to another input terminal of the AND circuit 81. The counter 80*a* has its output terminal connected to the warning device 77 through the OR circuit 76 and also to the engine operating condition detecting circuit 65.

On the other hand, the $O_2$ sensor activation detecting circuit 61 has its output terminal connected to one input terminal of an OR circuit 83 by way of a flip flop circuit 82. The OR circuit 83 has its output terminal connected to the reset pule input terminal R of the counter 80*a*. The OR circuit 83 has another input terminal connected to the engine operating condition detecting circuit 65, and a still further input terminal to the output of the atmospheric pressure comparator 78, respectively.

Figure 4:
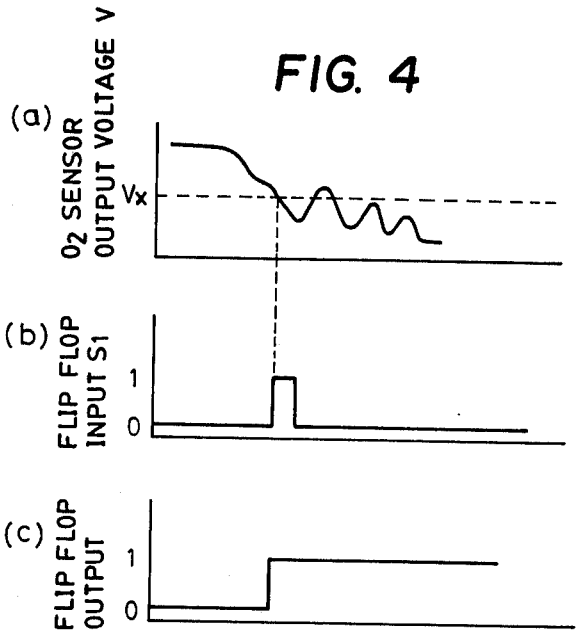
FIG. 4 is a timing chart showing the operation of second failure detecting means forming another part of the $O_2$ sensor—fail safe device in FIG. 2.

The operation of the second $O_2$ sensor-failure detecting arrangement A constructed above will now be described. When the $O_2$ sensor normally operates at the start of the engine, the output voltage V of the $O_2$ sensor gradually lowers as the temperature of the sensor increases, and drops below the predetermined voltage Vx, as shown in FIG. 4 (*a*). Upon the output voltage V crossing the predetermined voltage Vx, the $O_2$ sensor activation detecting circuit 61 generates a single pulse, as shown in FIG. 4 (*b*). The flip flop circuit 82 is triggered by this single pulse to generate a binary output of 1 (FIG. 4 (*c*)), which output is applied to the reset pulse input terminal R of the counter 80*a* of the abnormality determining circuit 80 by way of the OR circuit 83. After generation of the single pulse, the $O_2$ sensor activation detecting circuit 61 does not generate a further pulse even when the output voltage V of the $O_2$ sensor rises above or lowers below the predetermined voltage Vx afterward, so that the flip flop circuit 82 continues to generate the above output of 1 during operation of the engine. Therefore, the counter 80*a* is always kept in a resetted state by this output of 1 of the flip flop circuit 82 during operation of the engine. That is, the counter 80*a* never generates an abnormality-indicative signal $S_{14}$, referred to later, even when it is supplied with a high temperature-indicative signal, also referred to later, from the temperature determining circuit 79 and the control signal $S_4$ commanding open loop control from the engine operating condition detecting circuit 65.

Figure 5:
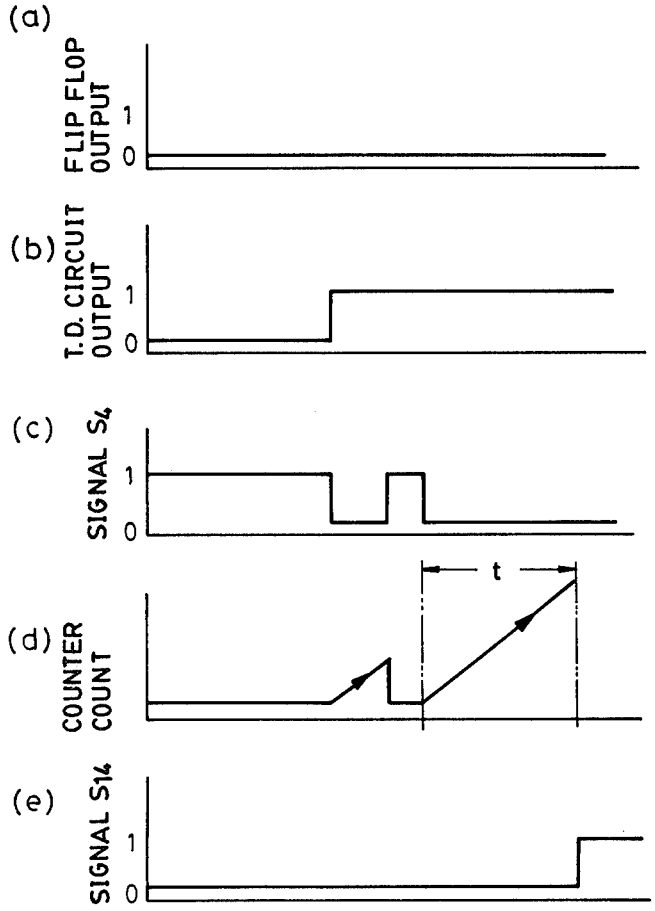
FIG. 5 is another timing chart showing the operation of the second failure detecting means.

In the event that there occurs no drop in the output voltage V of the $O_2$ sensor, that is, the same volage does not drop below the predetermined voltage Vx soon after the start of the engine due to a failure in the $O_2$ sensor or a break in the wiring related to the $O_2$ sensor, the $O_2$ sensor activation detecting circuit 61 never generates a single pule so that the flip flop circuit 82 continues to generate a binary output of 0 (FIG. 5 (*a*)). On this occasion, when the engine coolant temperature signal Tw rises in voltage above the reference voltage corresponding to the predetermined value Twx (e.g., 35° C.) as the warming-up of the engine proceeds, the comparator COMP of the temperature determining circuit 79 generates an output of 1 as the high temperaure-indicative signal (FIG. 5 (*b*)), which is applied to the one input terminal of the AND circuit 81. Sine the AND circuit 81 has its other input terminal supplied with a pulse train having a constant period from the oscillator 80*b*, it applies this pulse train to the counting pulse input terminal of the counter 80*a*.

On the other hand, the engine operation detecting circuit 65 detects fulfillment of the cloed loop control condition and open loop control conditions of the air/fuel ratio on the basis of the engine rpm signal Ne, the intake pipe-absolute pressure signal PB and the atmospheric pressure signal PA. Upon fulfillment of the closed loop control condition, the circuit 65 generates the control signal $S_4$ having a low level of 0 to command closed loop control operation, and upon fulfillment of an open loop control condition it generates the control signal $S_4$ having a high level of 1 to command open loop control operation, the control signal $S_4$ being applied in both cases to the reset pulse input terminal R of the counter 80*a* by way of the OR circuit 83 (FIG. 5 (*c*)). As previously mentioned, at the start of the engine, the open loop control operation is continuously executed where the pulse motor is held at the predetermined position PSCR, that is, the control signal $S_4$ is continuously generated at a high level of 1 to keep the counter 80*a* in a resetted state. Therefore, even if supplied with pules from the oscillator 80*b* by way of the AND circuit 81, the counter 80*a* has its count held at 0 (FIG. 5 (*c*), (*d*)).

Then, in transition from the above open loop control operation at the start of the engine to subsequent closed loop control operation, the control signal $S_4$ has its value changed to 0. Since on this occasion the output of the flip flop circuit 82 is held at 0 due to the failure in the $O_2$ sensor or its related parts, the OR circuit 83 produces an output of 0 to release the counter 80*a* from its resetted state and cause same to start counting pulses from the oscillator 80*b*. The counter 80*a* generates the abnormality-indicative signal $S_{14}$ which has a high level of 1, upon counting up a predetermined number of pulses outputted from the oscillator 80*b*, corresponding to a predetermined period of time t (e.g., 10 minutes) (FIG. 5(*d*), (*e*)), the above abnormality-indicative signal $S_{14}$ being applied to the warning device 77 through the OR circuit 76 to actuate same. The same signal $S_{14}$ is also supplied to the engine operating condition detecting circuit 65 which in turn operates on this signal $S_{14}$ to generate the control signal $S_4$ to interrupt the operation of the PI control circuit 63 and read from the present value register 66 the predetermined preset value PSIDL and its corresponding correcting coefficient Cidl into the arithmetic circuit 67 so that the pulse motor 5 is driven to the atmospheric pressure-compensated predetermined position PSIDL and held there in the aforementioned manner. If required, the pulse motor may be driven to and held at another predetermined preset position PSFS in place of the present position PSIDL.

The aforementioned atmospheric pressure comparator 78 is comprised of a comparator $COMP_2$ which has its inverting input terminal connected to the atmospheric pressure sensor 10 in FIG. 1 by way of a resistance $R_6$, and its non-inverting input terminal to the junction of a resistance $R_4$ with a resistance $R_5$, the reistances $R_4$ and $R_5$ being serially connected between the positive power supply source and the ground to provide a reference voltage at their junction, which corresponds to the aforementioned predetermined atmospheric pressure value PAMIN. The output of the comparator $COMP_2$ is connected to the OR circuits 75*a* and 83.

Figure 6:
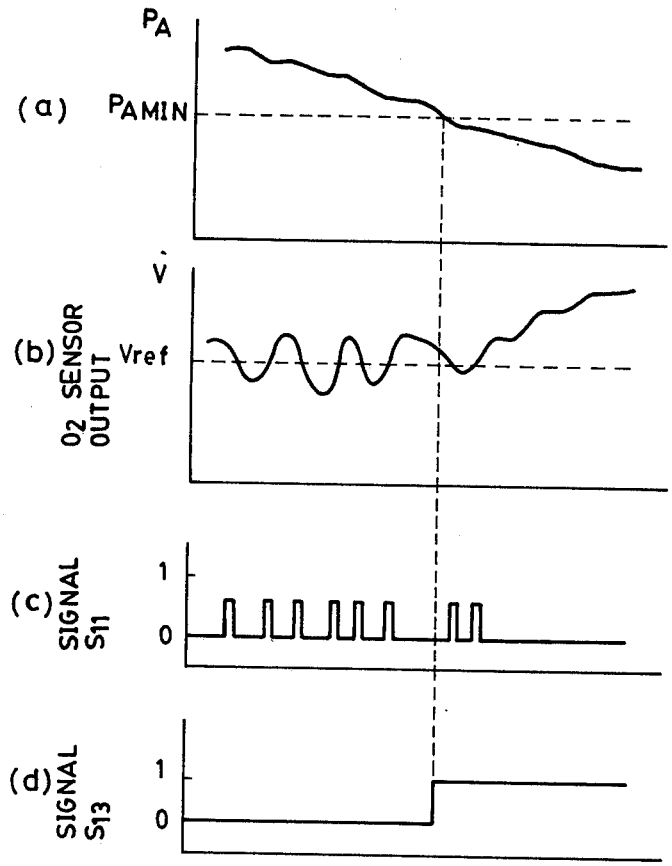
FIG. 6 is a timing chart showing the manner of rendering the first failure detecting means inoperative.

In operation at a high altitude where atmospheric pressure PA has a value lower than the predetermined value PAMIN, the comparator $COMP_2$ generates a binary output of 1. On the other hand, when atmospheric pressure PA is lower than the predetermined pressure PAMIN, the comparator $COMP_2$ generates a binary output of 0. Assuming now that the signals $S_2$ and $S_4$ applied to the input terminals of the OR circuit 75*a* of the first $O_2$ sensor-failure detecting block A both have a low level of 0, that is, activation of the $O_2$ sensor has been determined by the activation determining circuit 62 and it has been determind by the engine operating condition detecting circuit 65 that control of the engine operation is being effected in closed loop mode, the mixture being supplied to the engine becomes richer with a decrease in the atmospheric pressure PA, as previously noted. When atmospheric pressure still has a value higher than the predetermined value PAMIN, the feedback control system can perform proper feedback control responsive to the output signal V of the $O_2$ sensor to keep the air/fuel ratio of the mixture at the theoretical value or values in its vicinity. On this occasion, the output voltage V of the $O_2$ sensor incessantly changes to the higher level side and lower level side with respect to the reference voltage Vref (FIG. 6 (*a*)

and (*b*)) so that the counter 75*b* is resetted by consecutive pulses of the inversion-indicative signal $S_{11}$ each generated upon inversion of the output of the $O_2$ sensor (FIG. 6 (*c*)) before it counts up the predetermined number of pulses supplied from the oscillator 75*c* (that is, before the predetermined period of time t passes). Thus, no abnormality-indicative signal $S_{12}$ having a high level of 1 is generated (FIG. 3 (*e*) and (*f*)). When atmospheric pressure PA drops below the predetermined pressure PAMIN to such a level that feedback correction is no more possible of the air/fuel ratio of the mixture which is then too rich, the enriched mixture is supplied to the engine so that the output signal V of rhe $O_2$ sensor remains at a high level above the predetermined reference value Vref (FIG. 6 (*b*)). Thus, no pulse of the singnal $S_{11}$ is generated, which would cause the counter 75*b* to count up the predetermined number of pulses outputted from the oscillator 75*b* corresponding to the predetermined period of time t to generate the abnormality-indicative signal $S_{12}$ having a high level of 1, as previously stated, though there is then no failure in the $O_2$ sensor and its related parts. However, according to the invention, when atmospheric pressure PA drops below the predetermined pressure PAMIN, the atmospheric pressure comparator 78 generates a signal $S_{13}$ having a high level of 1 (FIG. 6 (*d*)), which is applied to the reset pulse input terminal R of the counter 75*b* through the OR circuit 75*a*. As long as atmospheric pressure PA remains below the predetermined pressure PAMIN, the above high level signal $S_{13}$ is continuously generated by the comparator 78 to keep the counter 75*b* in a resetted state. That is, the first failure detecting block A is kept inoperative as long as the high level signal $S_{13}$ is generated. Thus, generation of the abnormality-indicative signal $S_{12}$ is prevented to prohibit execution of safety functions such as warning.

When atmospheric pressure PA returns to a level higher than the predetermined value PAMIN, the atmospheric pressure comparator 78 again generates the signal $S_{13}$ having a low level of 0 to allow the first failure detecting block A to resume its operation.

Reference will now be made to the signal $S_4$ supplied to the OR circuit 83 of the second $O_2$ sensor-failure detecting block B as well as to the output of the flip flop circuit 82 of the same block. When the engine is operated in a place where atmospheric pressure PA prevails, which is lower than the predetermined pressure PAMIN, the mixture becomes too rich even after activation of the $O_2$ sensor has been completed, due to the low atmospheric pressure PA, and as a consequence no drop occurs at all in the output level of the $O_2$ sensor below the predetermind activation-determining voltage Vx after the start of the engine (FIG. 7 (*a*)). In such event, no single pulse, which is shown in FIG. 4 (*b*), is generated from the $O_2$ sensor activation-detecting circuit 61 so that the output of the flip flop circuit 82 remains at a low level of 0 continuously from the start of the engine. On this occasion, the counter 80*a* would count up the predetermined number of pulses supplied from the oscillator 80*b*, which corresponds to the predetermined period of time t to generate the abnormality-indicative signal $S_{14}$ in spite of no failure then occurring in the $O_2$ sensor and its related parts.

Figure 7:
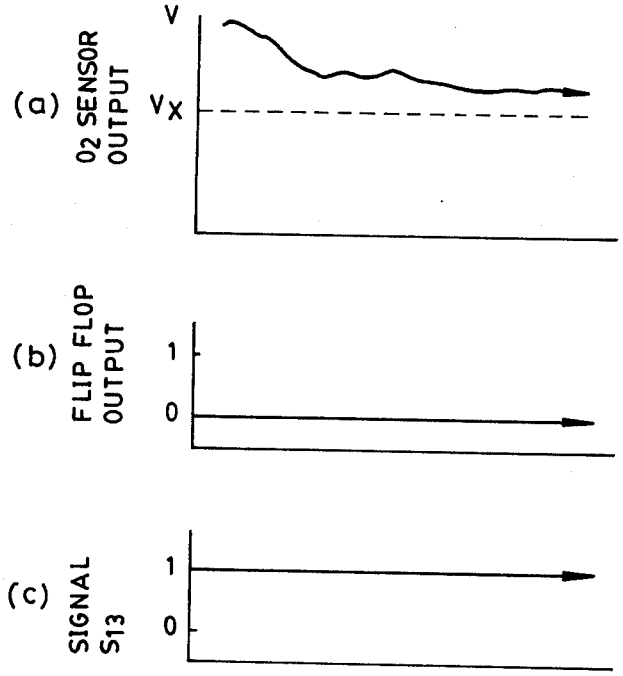
FIG. 7 is a timing chart showing the manner of rendering the second failure detecting means inoperative.

To avoid the above phenomenon, the atmospheric pressure comparator 78 generates its signal $S_{13}$ having a high level of 1 immediately upon the start of the engine when atmospheric pressure PA is lower than the predetermined pressure PAMIN, and the signal $S_{13}$ is applied to the OR circuit 83 (FIG. 7 (*c*)) to render the second failure detecting circuit B inoperative. On the other hand, when atmospheric pressure PA becomes higher than the predetermined pressure PAMIN, the level of the above signal $S_{13}$ is inverted to 0 to release the second failure detecting circuit B from its inoperative state.

Although the foregoing embodiment described with reference to FIGS. 2 through 7 according to the present invention is applied to an air/fuel ratio feedback control system including two failure detecting circuits A and B, the invention may be applied to a control system of this kind having a single such failure detecting circuit, as well.

What is claimed is:

1. An air/fuel ratio feedback control system for combination with an internal combustion engine, comprising: first sensor means for detecting the concentration of oxygen present in exhaust gases emitted from said engine; valve means having a valve body disposed to determine the air/fuel ratio of an air/fuel mixture being supplied to said engine; electronic control means operable in response to an output signal of said first sensor means to drive said valve means, whereby the air/fuel ratio of said mixture is controlled to a predetermined value in a feedback manner responsive to changes in the concentration of oxygen present in exhaust gases emitted from said engine; means adapted to generate a first signal as long as a predetermined condition for effecting said feedback control of the air/fuel ratio of said mixture is fulfilled; means adapted to generate a second signal as long as said first sensor means is activated; means adapted to determine an actual air/fuel ratio of said mixture from the value of said output signal of said first sensor means and to generate a third signal having a binary value invertible depending upon whether the air/fuel ratio thus determined is larger or smaller than said predetermined value; safety means arranged to be supplied with said first, second and third signals for performing a predetermined safety action when no inversion ocurs in said third signal inputted thereto for a predetermined period of time while simultaneously said first and second signals are both inputted thereto; second sensor means for detecting ambient atmospheric pressure ; and means adapted to render said safety means inoperative when a value of ambient atmospheric pressure detected by said second sensor means is lower than a predetermined value.

2. The air/fuel ratio feedback control system as claimed in claim 1, further including third sensor means for detecting the temperature of said engine, means adapted to generate a fourth signal when a value of the temperature of said engine detected by said third sensor means is higher than a predetermined value, second safety means arranged to be supplied with said first, second and fourth signals for performing a predetermined safety action when said second signal is not inputted thereto within a second predetermined period of time after said second and fourth signals have both been inputted thereto, and wherein said means for rendering said first-mentioned safety means inoperative is adapted to render both of said first-mentioned safety means and said second safety means inoperative when a value of ambient atmospheric pressure detected by said second sensor means is lower than said predetermined value of atmospheric pressure.

3. The air/fuel ratio feedback control system as claimed in claim 2, wherein said third sensor means is adapted to detect the temperature of cooling water for said engine.

4. The air/fuel ratio feedback control system as claimed in any one of claim 1 or claim 2, wherein said predetemined value of atmospheric pressure is a value below which the air/fuel ratio of said mixture can assume a value too small for said engine to properly operate, even when said feedback control of the air/fuel ratio of said mixture is carried out by said electronic control means.

5. An air/fuel ratio feedback control system for combination with an internal combustion engine, comprising: first sensor means for detecting the concentration of oxygen present in exhaust gases emitted from said engine; valve means having a valve body disposed to determine the air/fuel ratio of an air/fuel mixture being supplied to said engine; electronic control means operable in response to an output signal of said sensor means to drive said valve means, whereby the air/fuel ratio of said mixture is controlled to a predetermined value in a feedback manner responsive to changes in the concentration of oxygen present in exhaust gases emitted from said engine; means adapted to generate a first signal as long as a predetermined condition for effecting said feedback control of the air/fuel ratio of said mixture is fulfilled; means adapted to generate a second signal as long as said sensor means is activated; second sensor means for detecting the temperature of said engine; means adapted to generate a third signal when a value of the temperature of said engine detected by said second sensor means is higher than a predetermined value; safety means arranged to be supplied with said first, second and third signals for performing a predetermined safety action when said second signal is not inputted thereto within a predetermined period of time after said first and third signals have both been inputted thereto; third sensor means for detecting ambient atmospheric pressure; and means adapted to render said safety means inoperative when a value of ambient atmospheric pressure detected by said third sensor means is lower than a predetermined value.

* * * * *

UNITED STATES PATENT AND TRADEMARK OFFICE

CERTIFICATE OF CORRECTION

PATENT NO. : 4,434,764

DATED : March 6, 1984

INVENTOR(S) : Shumpei Hasegawa, Shin Narasaka, Kazuo Otsuka

It is certified that error appears in the above-identified patent and that said Letters Patent is hereby corrected as shown below:

column 3, line 32: change "after the second" to read "after the first";

column 16, line 58: change "after said second" to read "after said first.

Signed and Sealed this

*Twelfth* Day of *June 1984*

[SEAL]

*Attest:*

GERALD J. MOSSINGHOFF

*Attesting Officer*

*Commissioner of Patents and Trademarks*